United States Patent [19]

Brandt

[11] Patent Number: 4,628,626

[45] Date of Patent: Dec. 16, 1986

[54] SAFETY MECHANISM FOR FIREARMS

[76] Inventor: Raymond W. Brandt, 5828 Wheelock, Fort Wayne, Ind. 46815

[21] Appl. No.: 630,539

[22] Filed: Jul. 13, 1984

[51] Int. Cl.[4] ..... F41C 17/00

[52] U.S. Cl. ..... 42/70.01; 42/70.06; 42/70.08; 42/70.11

[58] Field of Search ..... 42/70 R, 70 E, 70 F, 42/1 LP

[56] References Cited

U.S. PATENT DOCUMENTS

| | | | |
|---|---|---|---|
| 1,072,335 | 9/1913 | Kunz | 42/70 F |
| 3,949,508 | 4/1976 | Elkas | 42/70 X |
| 3,978,604 | 9/1976 | Smith | 42/70 E |
| 3,979,850 | 9/1976 | Schiessl et al. | 42/70 X |
| 4,002,101 | 1/1977 | Tellie | 42/70 X |
| 4,011,678 | 3/1977 | Brodbeck et al. | 42/70 F |

*Primary Examiner*—Peter A. Nelson

*Attorney, Agent, or Firm*—Marshall & Melhorn

[57] ABSTRACT

A safety mechanism for firearms includes a stop means such as a pin mounted to prevent the movement of the trigger and/or the hammer to a position enabling the firearm to be fired. The pin is pivotally mounted for movement to either side of the firearm to enable the actuation of the trigger or the hammer. In an alternate embodiment, the stop means can be a slide which is mounted in a slot adjacent to the hammer. The slide is moveable into and out of engagement with the hammer and can be spring biased to discourage unintentional movement.

15 Claims, 10 Drawing Figures

SAFETY MECHANISM FOR FIREARMS

BACKGROUND OF THE INVENTION

1. Field of the Invention

The present invention relates generally to a safety mechanism for firearms and in particular to a device for preventing the movement of the trigger and/or hammer of a firearm to a position which would result in a discharge of a loaded firearm.

2. Description of the Prior Art

Each year many persons are killed by the accidental discharge of firearms. Thus, there is a need for a device which will prevent the movement of a trigger and/or hammer to a position in which the firearm can be discharged. However, such a device must be easy to install and use in order to encourage the use of such a safety mechanism with all firearms.

Many types of safety devices for firearms are known. One group of such devices involves a pin or slide which is moved into and out of engagement with the hammer such as shown in U.S. Pat. Nos. 289,875; 311,323; 792,381; 1,227,531. Another type of safety mechanism involves a pin or lever which prevents the actuation of the trigger mechanism such as shown in U.S. Pat. Nos. 2,379,946; 2,458,616; 2,657,490; 3,153,874; 3,222,809; and 3,713,242. In the alternative, there is a class of devices which blocks the insertion of a finger in front of the trigger to prevent the actuation of the trigger such as shown in U.S. Pat. No. 2,195,693.

All of the above mentioned prior art devices have disadvantages such as being complicated in structure and requiring substantial modifications to the firearms. With respect to those devices which utilize removable pins, the pins are easily lost rendering the safety mechanism inoperable.

SUMMARY OF THE INVENTION

The present invention is concerned with a safety mechanism for firearms which is easy to install and operate and does not include a removable part which can be lost rendering the mechanism inoperative. In one embodiment, a stop means such as a pin can be mounted to prevent the movement of the trigger and/or the hammer to a position enabling the firearm to be fired. The pin is capable of being swiveled toward either side of the firearm to enable the actuation of the trigger or the hammer thereby rendering the gun operable. This device allows the same firearm to be utilized by either a right-handed or left-handed person.

In another embodiment, a stop means such as a slide is mounted in a slot adjacent the hammer of the firearm and is movable into and out of engagement with the hammer. The slide is spring biased to discourage unintentional movement.

It is an object of the present invention to provide a safety mechanism for a firearm which can be easily operated by either a right-handed person or a left-handed person.

It is another object of the present invention to provide a safety mechanism for firearms which is easily attached to the firearm after the manufacture of the firearm.

It is a further object of the present invention to provide a safety mechanism for a firearm which is economical to manufacture and install on firearms.

It is a further object of the invention to provide a safety mechanism for firearms which is child resistant.

DETAILED DESCRIPTION OF THE DRAWINGS

DESCRIPTION OF THE PREFERRED EMBODIMENT

Figure 1:
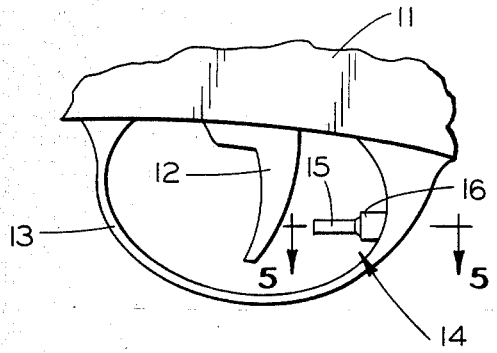
FIG. 1 is a side view of the trigger area portion of a firearm showing a safety mechanism according to the present invention for preventing the actuation of the trigger.

There is shown in FIG. 1 the trigger portion of a typical firearm including a frame or body 11 from which a trigger 12 extends. A portion of the trigger 12 extends into the body 11 and is pivotally attached therein for movement between the position shown and an actuated position in the direction of the arrow for firing the firearm. A trigger guard 13 is attached to the frame 11 to prevent accidental contact with the trigger which would tend to discharge a firearm.

The trigger guard 13, however, does not prevent the accidental discharge of a firearm by someone who inserts a finger inside the guard and moves the trigger to the actuated position. A safety mechanism 14 according to the present invention can take the form of a stop means such as a pin 15 extending from the trigger guard 13 to a position adjacent the trigger 12 thereby preventing the movement of the trigger 12 a distance in the actuating direction sufficient to discharge the firearm. The pin 15 extends from a base 16 which is mounted in the trigger guard 13.

Figure 2:
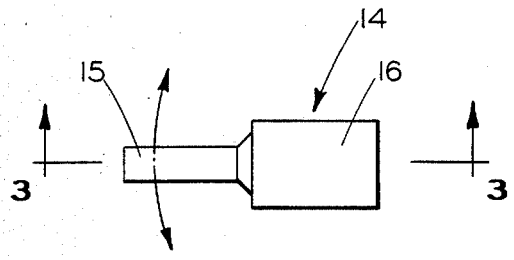
FIG. 2 is an enlarged top plan view of the safety mechanism shown in FIG. 1.

The safety mechanism 14 can be disabled by moving the pin 15 to either the right side or the left side of the trigger 12 a distance sufficient to allow the trigger 12 to be moved to its actuated position. As better shown in FIG. 2, the pin 15 is pivotally mounted in the base 16 for movement in the direction of the arrow. Thus, the pin is conveniently movable by either a right-handed or a left-handed person.

Figure 3:
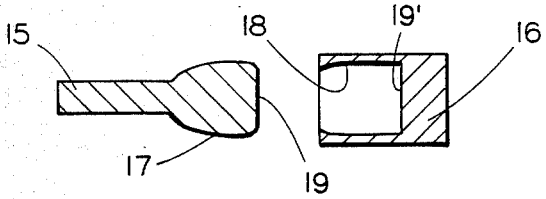
FIG. 3 is an exploded cross-sectional view of the safety mechanism shown in FIG. 1 as if taken along the line 3—3 in FIG. 2.

FIG. 3 is an exploded view of the safety mechanism 14 in cross-section. The pin 15 extends from a ball 17 having at least a portion of its external surface curved.

The ball 17 is engaged by a mating socket 18 formed in the base 16. Through the selection of the material and the fit between the ball 17 and the socket 18, the pin will be retained in whatever position it is moved to along the arrow shown in FIG. 2.

Figure 4:
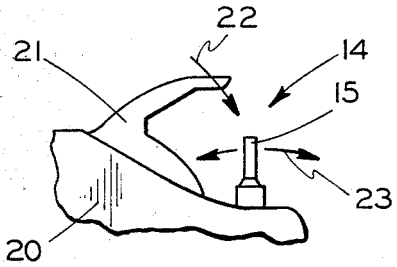
FIG. 4 is a side view of the hammer portion of a firearm showing the safety mechanism according to the present invention.

The safety mechanism 14 can also be utilized in cooperation with the hammer of a firearm. There is shown in FIG. 4 a frame 20 of a firearm. A hammer 21 extends into and is pivotally mounted inside the frame 20 for movement in the direction of the arrow 22 to enable the firearm to be fired by subsequent actuation of the trigger (not shown). The safety mechanism 14 can be mounted in the frame 20 in a position wherein the pin 15 extends into an area which will prevent the movement of the hammer 21 to the position in which the firearm is enabled to discharge. When it is desired to fire the firearm, the pin 15 can be moved in the direction of the arrow 23 out of the path of the hammer 21. In the alternative, the mechanism 14 can be mounted for movement of the pin to either side of the hammer 21.

Figure 5:
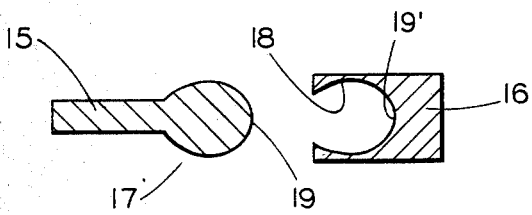
FIG. 5 is an exploded cross-sectional view of the safety mechanism shown in FIG. 4 as if taken along the line 5—5 in FIG. 1.

The pin 15 with ball 17 and the base 16 can be formed of a material having a relatively high coefficient of friction and of such dimensions as will maintain the pin 15 in any position to which it is moved. FIG. 5 is an exploded side elevational view of the pin 15 and base 16 in cross-section. As can be seen from FIG. 3 and FIG. 5, the base 17 and the socket 18 have mating, relatively flat surfaces 19 and 19' respectively to prevent any movement of the pin 15 in a vertical direction. Thus, the pin 15 has a limited range of movement only in the horizontal direction into and out of the path of travel of the trigger 12.

Figure 6:
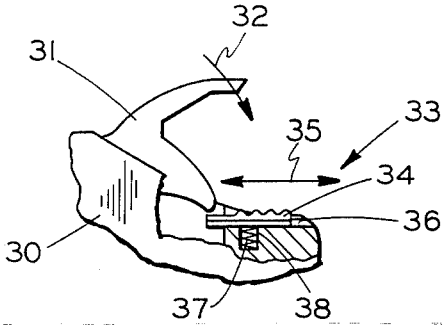
FIG. 6 is a side elevational view of the hammer portion of a firearm in partial section showing an alternate embodiment of the safety mechanism according to the present invention.

There is shown in FIG. 6 an alternate embodiment of the safety mechanism according to the present invention. A frame 30 of a firearm is shown in side elevation with a portion in section. A hammer 31 extends into and is pivotally mounted (not shown) in the frame 30 for movement in the direction of an arrow 32. Such movement of the hammer 31 enables the firearm to be discharged by movement of a trigger (not shown).

Figure 7:
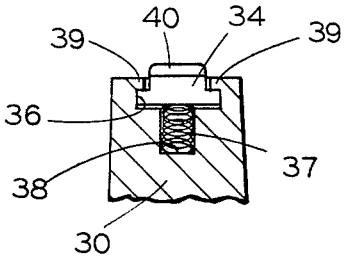
FIG. 7 is an enlarged cross-sectional view of the safety mechanism shown in FIG. 6 as if taken along the line 7—7 in FIG. 6.

A safety mechanism 33 in accordance with an alternate embodiment of the present invention includes a stop means such as a slide 34 which is movable into and out of engagement with the hammer 31 along a path defined by an arrow 35. The slide 34 is retained in a slot 36 which can be formed in the frame 30. As best shown in FIG. 7 the slide 34 and the slot 36 can be formed in the shape of an inverted "T". Thus, the slide 34 is limited in movement in a vertical direction, but can move in a horizontal direction along the path of the arrow 35.

Figure 8:
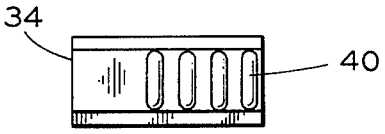
FIG. 8 is an enlarged top plan view of the slide of the safety mechanism shown in FIG. 6.
Figure 9:
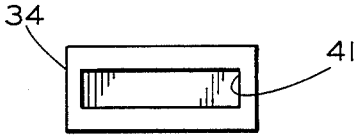
FIG. 9 is an enlarged bottom plan view of the slide shown in FIG. 6.

To prevent accidental movement of the slide 34 in the slot 36, a spring 37 is retained in an aperture 38 formed in the bottom of the slot 36. A spring 37 biases the slide 34 upwardly against overlapping edges or flanges 39 of the slot 36. The slide 34 can be formed with a series of ridges 40 on its upper surface to enable a person to better grip the slide for movement. As best shown in FIG. 8, the ridges are formed at the end of the slide opposite the hammer engaging end. As shown in FIG. 9, the bottom surface of the slide 34 can have a recess 41 formed therein for retaining the upper end of the spring 37 thereby limiting the movement of the slide 34 in the slot 36.

Figure 10:
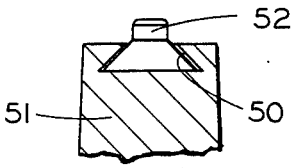
FIG. 10 is an enlarged elevational view of a portion of an alternate embodiment of a safety mechanism according to the present invention.

The slot 36 can be formed in other cross sectional shapes. As shown in FIG. 10, a slot 50 is formed in a frame 51 of a firearm. The slot 50 is formed in the same general area as the slot 36 shown in FIG. 7, but is dove tail shaped in cross section. A similarly shaped slide 52 is retained in the slot 50.

In accordance with the provisions of the patent statutes, the principle and mode of operation of the invention have been explained in its preferred embodiments. However, it must be understood that the invention may be practiced otherwise than as specifically illustrated and described without departing from its spirit or scope.

What is claimed is:

1. A safety mechanism for a firearm, the firearm including an element adapted to be moved between a safe position wherein the firearm cannot be discharged and an actuated position wherein the firearm is capable of being discharged, comprising:

a stop means including a pin attached to a ball;

means for engaging said stop means to limit movement of said stop means for a predetermined distance along a predetermined path including a socket for retaining said ball, said ball and said socket cooperating to maintain said pin in any of a plurality of selected positions along said predetermined path; and means for attaching said stop means to the firearm in a position adjacent the element for actuating the firearm whereby said stop means is movable along said predetermined path between at least one position wherein the element cannot be actuated and at least one other position wherein the element can be actuated.

2. The safety mechanism according to claim 1 wherein said means for engaging includes a base having said socket formed therein for retaining said pin to limit movement of said pin along said predetermined path.

3. The safety mechanism according to claim 2 wherein said base is adapted to be retained in an aperture formed in the firearm.

4. The safety mechanism according to claim 1 wherein the element is a trigger pivotally mounted on said firearm.

5. The safety mechanism according to claim 1 wherein the element is a hammer pivotally mounted on the firearm.

6. The safety mechanism according to claim 1 wherein said ball and said means for engaging are formed of a relatively high coefficient of friction material whereby said pin is maintained in a selected position along said predetermined path.

7. The safety mechanism according to claim 1 wherein said means for frictionally retaining is a slot formed in the firearm and said stop means is adapted to be slidably retained in said slot.

8. The safety mechanism according to claim 7 wherein said slot is formed with flanges extending along opposite edges of an opening of the slot and including spring means for biasing said stop means against said flanges

9. The safety mechanism according to claim 8 wherein said spring means is retained in an aperture formed in a bottom surface of said slot.

10. The safety mechanism according to claim 8 wherein said stop means is formed with a recess in a bottom surface thereof and said spring means extends into said recess for limiting the travel of said stop means along said predetermined path.

11. The safety mechanism according to claim 7 wherein said stop means includes a plurality of ridges formed along an upper surface thereof.

12. The safety mechanism according to claim 1 wherein said ball and said socket are formed with generally curved mating surfaces in one plane and with relatively flat mating surfaces in another plane to limit said predetermined path to said one plane.

13. The safety mechanism according to claim 12 wherein said one plane and said another plane are orthogonally related and include the longitudinal axis of said pins.

14. A safety mechanism for a firearm wherein the firearm includes an element adapted to be moved between a safe position wherein the firearm cannot be discharged and an actuated position wherein the firearm is capable of being discharged, comprising:

a stop means having an elongated body with one end adapted to engage an element for actuating a firearm and opposite end; and means for frictionally retaining said opposite end of said elongated body to limit movement of said one end of said stop means for a predetermined distance along a predetermined path.

15. The safety mechanism according to claim 14 wherein said stop means is a pin having a ball formed on said opposite end and said means for frictionally retaining includes a base having a socket formed therein for retaining said ball.

* * * * *